US005517742A

United States Patent [19]

Mann

[11] Patent Number: 5,517,742

[45] Date of Patent: May 21, 1996

[54] METHOD OF SETTING A JOINT INCLUDING A TORQUE LIMITED FASTENER

[75] Inventor: Brian Mann, West Bloomfield, Mich.

[73] Assignee: Detroit Tool Industries Corporation, Madison Heights, Mich.

[21] Appl. No.: 389,223

[22] Filed: Feb. 15, 1995

Related U.S. Application Data

[62] Division of Ser. No. 54,977, Apr. 30, 1993, Pat. No. 5,390, 573.

[51] Int. Cl.[6] ..... B21D 39/00

[52] U.S. Cl. ..... 29/456; 29/525.02; 29/525.11

[58] Field of Search ..... 29/456, 525.1

[56] References Cited

U.S. PATENT DOCUMENTS

| | | | |
|---|---|---|---|
| Re. 31,284 | 6/1983 | Holmes | 411/311 |
| 3,603,132 | 9/1971 | Holmes | 72/402 |
| 4,023,914 | 5/1977 | Holmes | 408/220 |
| 4,074,950 | 2/1978 | Holmes | 408/220 |
| 4,076,064 | 2/1978 | Holmes | 151/14 R |
| 4,150,702 | 4/1979 | Holmes | 151/22 |
| 4,171,012 | 10/1979 | Holmes | 151/14 R |
| 4,181,457 | 1/1980 | Holmes | 408/217 |
| 4,220,187 | 9/1980 | Holmes | 151/20 |
| 4,258,607 | 3/1981 | McKewan | 411/417 |
| 4,260,005 | 4/1981 | Stencel | 411/3 |
| 4,266,590 | 5/1981 | McKewan | 411/307 |
| 4,293,262 | 10/1981 | Holmes | 411/311 |
| 4,351,626 | 9/1982 | Holmes | 411/311 |
| 4,396,321 | 8/1983 | Holmes | 408/217 |
| 4,423,893 | 1/1984 | Holmes | 285/334 |
| 4,547,104 | 10/1985 | Holmes | 408/220 |
| 4,594,039 | 6/1986 | Witte | 411/311 |
| 4,661,031 | 4/1987 | Heine | 411/263 |
| 4,682,520 | 7/1987 | Gray | 81/471 |
| 4,734,002 | 3/1988 | Holmes | 411/311 |
| 4,759,237 | 7/1988 | Fauchet et al. | 81/53.2 |
| 4,784,549 | 11/1988 | Wing | 411/1 |
| 4,823,653 | 4/1989 | Batten | 81/468 |
| 4,826,377 | 5/1989 | Holmes | 411/311 |
| 4,858,299 | 8/1989 | Wing | 29/446 |
| 4,881,316 | 11/1989 | Wing | 29/510 |
| 4,983,084 | 1/1991 | Gray | 411/311 |
| 5,012,704 | 5/1991 | Wing | 81/59.1 |
| 5,301,573 | 4/1994 | Weber et al. | 81/53.2 |

OTHER PUBLICATIONS

Machinery's Handbook, by Erik Oberg, Franklin D. Jones and Holbrook L. Horton, 20th Ed., Second Printing, 1976, pp. 1274–1279, 1282–1285, 1290–1295, 1342–1343, 1360–1361 and 1218–1229.

*Primary Examiner*—David P. Bryant
*Attorney, Agent, or Firm*—Harness, Dickey & Pierce

[57] ABSTRACT

Axially extending lobes extend radially from an internally threaded nut and form axial troughs that receive a respective axial cone mounted in the socket of a driver, the cones being rotatably driven against the lobes to apply a threading torque to the nut. At a predetermined torque, an axial outer radial end portion of the material forming the lobe is plastically deformed, but not sheared off, thereby allowing the socket to rotate and the cones to advance against the next respective lobe. The deformed lobe indicates to the user that the nut was properly torqued and the deformed material does not shear off thereby indicating that the nut had not been tampered with. To permit relaxation, a second torquing could be done at a later time.

5 Claims, 3 Drawing Sheets

METHOD OF SETTING A JOINT INCLUDING A TORQUE LIMITED FASTENER

This is a division of U.S. patent application Ser. No. 08/054,977, filed Apr. 30, 1993 now U.S. Pat. No. 5,390,573.

FIELD OF THE INVENTION

This invention relates to a fastening system for a locking nut in which the socket wrench of a nut driver applies a visual mark to the locking nut when a predetermined torque is reached.

In a standard threaded fastener -system a female fastener has internal threads that thread onto the external threads of a male fastener. Wrenching surfaces of the mating fasteners accept tools that allow the fasteners to be tightened and one or more workpieces to be clamped together between the wrenching surfaces. The combination of the mating fasteners and the workpieces is commonly referred to as a "joint." Male threaded fasteners are known as screws, bolts and pins; female fasteners are known as nuts or collars.

Adequate clamp-up or preload is absolutely necessary for a satisfactory joint. A fastener adequately loaded by the reaction to clamp-up load resists fatigue failure. Accordingly it is desirable to know the clamp-up load the fastener applies to a structure to be sure that the Joint has adequate fatigue strength.

The clamp-up tightening load correlates to the resistance of the nut to further threading on the bolt and against the workpiece by the application of-torque to the nut. As the tightening load is increased, resistance to further threading increases, and the torque required to turn the nut increases.

U.S. Pat. No. 4,260,005 issued Apr. 7, 1981 to Stencel describes a load limiting and self locking collar that has a plurality of circumferentially spaced lobes on its outside that serve as wrenching surfaces and in torque limitation. A triangular shaped socket (i.e., the wrenching tool) has flats that engage flanks of the lobes and turn the collar with respect to the bolt. Upon reaching a predetermined clamping load, the lobes fail in radial compression and merge into the body of the collar and wrenching stops because the lobes no longer provide material for the socket. The inward radial deformation of the lobes deforms the material of the collar radially inward and against the threads of the cooperating bolt to produce a thread lock when the lobes fail.

Impact wrenches used in setting fasteners do so rapidly and the failures of the lobes occur over a very few degrees of rotation. The rapid application of setting torques to the collar can result in a loss of pre-load through relaxation of the sheets; relaxation results from the continued deformation of the sheets after the initial loading. Such deformation reduces the load per unit area and absolute loading because material moves away from the clamped zone.

When the lobes fail, they fail at the load corresponding to a desired pre-load. However, relaxation is a time dependent phenomena and with slower development of pre-load, relaxation and loss of pre-load will be less.

In some applications it may be desirable to be able to change the pre-load, even with the same nut. For example, when the sheets are not as strong in compression as some other sheets, it may be necessary to lower the compression on them.

An important aspect of fasteners used in aerospace applications is provision of a known and repeatable clamping load. This load correlates directly with the torque that sets the fastener. In some applications, a lot of the setting torque is not used in developing clamping but overcoming friction. Secondary wrenching may be desired in order to increase the pre-load above a design pre-load to compensate for relaxation and incomplete tightening.

Another important aspect of a fastening system is a visual indication that the "joint" has been properly torqued and not otherwise tampered with. Such arrangements are known in Wing U.S. Pat. Nos. 4,784,549 issued Nov. 15, 1988; 4,858,299 issued Aug. 21, 1989; 4,881,316 issued Nov. 21, 1989; and 5,012,704 issued Jun. 21, 1989. Wing generally teaches that an indenting ball be provided in each of first and second wrenches and that the indenting balls be rotatably driven across and into the outer axial surface of an axial lobe extending radially from the nut whereby to "gouge" two axially spaced grooves circumferentially across the lobe so engaged. In this approach, the surface indenting balls can shear small portions of material from the nut when forming the groove, the material sheared contaminating the system in which the fasteners are installed and the exposed groove being prone to corrosion.

SUMMARY OF THE INVENTION

According to the present invention, axially extending lobes from an internally threaded nut are rotatably driven by carbide cones rollably mounted in the socket of a drive wrench. At a predetermined torque, the outer radial end portion of the material forming the lobe is plastically deformed by being radially flattened in a direction towards the nut, but not sheared off, thereby allowing the socket to rotate relative to the lobes and the cones to advance against the next successive lobe. Thereafter, should the clamping load on the joint relax, the process is repeated and the cones driven into engagement with the lobes a second time.

Advantageously, the radially flattened lobes provide a visual indication to the user that the nut was properly torqued. Because the lobe is also flattened angularly in the direction of torquing, a release tool would shear off the angularly flattened portion, thereby providing an indication that the nut had been tampered with.

Additional objects, advantages and features of the present invention will become apparent from the following description and appended claims, taken in conjunction with the accompanying drawings.

DETAILED DESCRIPTION OF THE INVENTION

Figure 1:
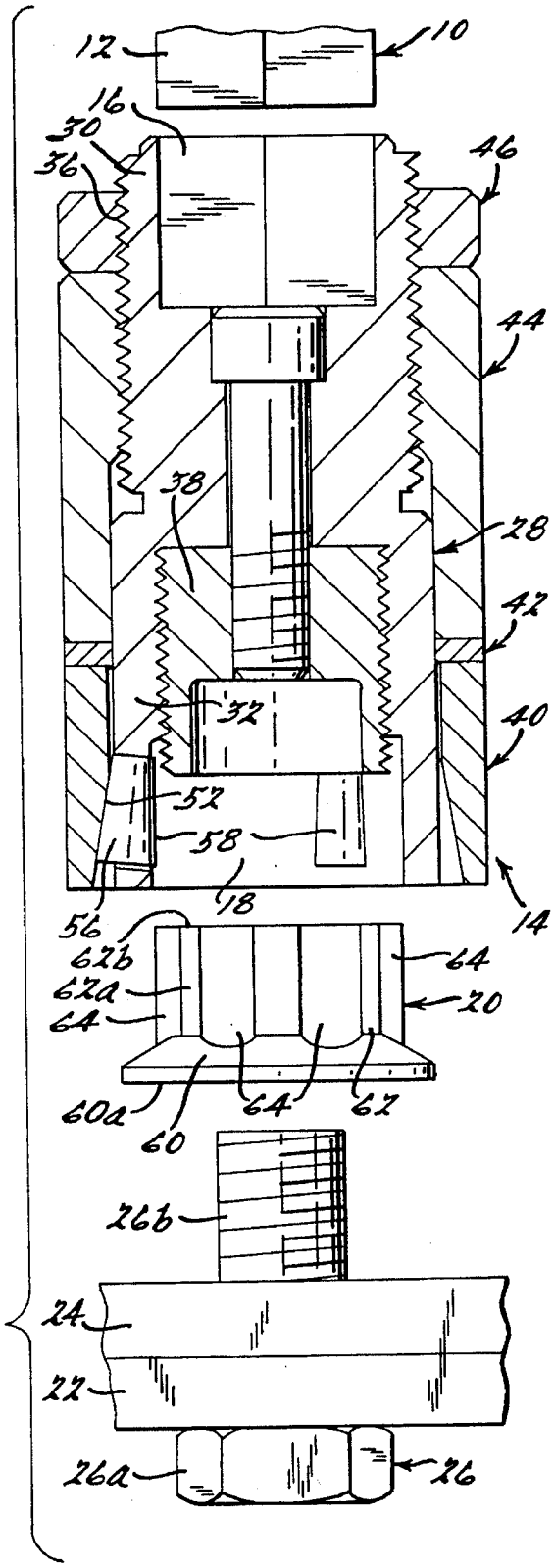
FIGURE 1 is a longitudinal section view of a fastening system including a drive wrench and a drive socket adapted to drive a multi-lobed internally threaded nut into tightened relationship with an externally threaded fastener whereby to secure a pair of sheets together.

Referring now to the drawings, FIGURE i shows a fastening system including a power tool 10 having a rotatable axial driver 12 extending therefrom, a generally cylindrical socket wrench 14 having a rearward driver socket 16 to removably connect to the driver and a forward driver socket 18, a lobed lock nut 20 having an outer periphery adapted to be received within the forward socket 18 and an internally threaded axial bore (not shown), a pair of sheet members 22 and 24 forming an aligned set of bolt holes (not shown), and a bolt 26 having a head 26*a* adapted to seat against the sheet 22 and an externally threaded axial body 26*b* extending through the bolt holes for threadable connection to the lock nut. The bolt head 26*a* is formed with wrenching surfaces to assist in torquing the threaded body to the lock nut. The power tool 10 is adapted to be powered by conventional means, and the driver 12 is formed with a cross-section adapted to interlock within the rearward driver socket 16. While many configurations are possible, as shown, the cross-section of the driver 12 and driver socket 16 are square.

Figure 2:
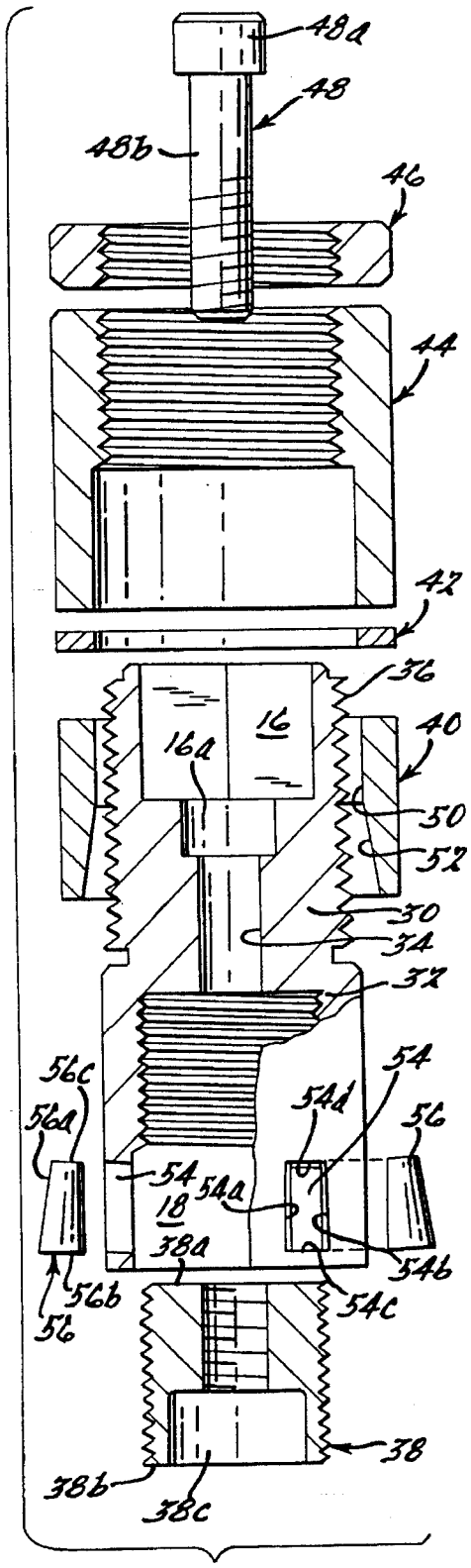
FIG. 2 is an exploded longitudinal section view of the drive socket shown in FIG. 1.
Figure 3:
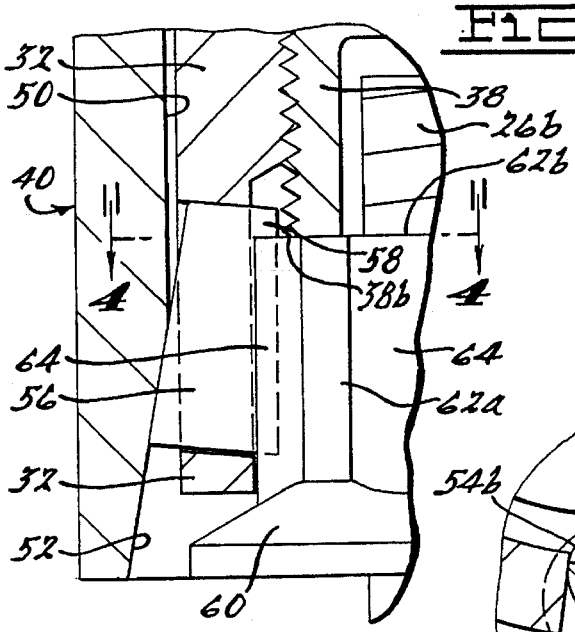
FIG. 3 is an enlarged section view taken along line 3—3 of FIG. 2 showing the drive socket and a socket race.

Referring primarily to FIGS. 1 and 2, the socket wrench 14 has a central axis of rotation and each of the elements of the wrench are generally concentrically arranged thereto. The socket wrench 14 comprises a generally cylindrical body 28 having rearward and forward end portions 30 and 32 formed to include the sockets 16 and 18 and a stepped bore 34 extending centrally through the body and between the sockets 16 and 18, the inner wall of the forward driver socket 18 and the outer periphery 36 of the end portion 30 being partially threaded, a stop nut 38 threadably mounted in the socket 18, and a race 40, a thrust washer 42, a sleeve 44 and a jam nut 46, in that order, disposed on the outer periphery 36 of the body 28. A threaded fastener 48 is disposed in the stepped bore 34 such that its head 48*a* is disposed in a socket 16*a* and is abutted against an endwall thereof and its body 48*b* extends into the socket 18 and is threadably connected to the stop nut 38.

The stop nut 38 is generally cylindrical and has a stepped bore extending coaxially between its opposite axial end faces 38*a* and 38*b*, the end face 38*a* being adapted to abut an axial endwall of the socketing, and the end face 38*b* being adapted to seat against the top the lock nut 20. The outer surface of the stop nut is formed with thread which engages with the thread in the forward socket 18 which permits the seated position of the lock nut to be axially changed relative to the socket 18. The stepped bore is partially internally threaded to threadably engage with the fastener body 48*b* and is formed with a cylindrical socket or cavity 38*c* which extends axially inward from the end face 38*b* to receive an axial end portion of the threaded fastener 26.

The sleeve 44 is generally cylindrical and has a forward axial end face which abuts against the rearward axial face of the thrust washer 42 and a rearward axial end face that abuts against the jam nut 46. The sleeve 44 and jam nut 46 are internally threaded and threadably connect to the external thread on the rearward end-portion 30. Advantageously, the threadable interconnection enables the sleeve 44 to be moved axially relative to the body portions 30 and 32 and the axial position of the race 40 to be changed relative to the forward end portion of the body, whereby to adjust the torque, in a manner to be described.

The race 40 is generally cylindrical and extends between forward and rearward axial end faces, the rearward axial end face abutting against the forward axial end face of the thrust washer 42. The inner wall of the race includes a cylindrical rearward wall portion 50 which is dimensioned to provide an axial sliding clearance fit about the outer periphery 36 of the forward end portion 32 and a radially outwardly tapering frusto-conical wall portion 52 which circumposes the forward end portion 32.

Preferably and according to this invention a plurality of axial slots 54 each sized to receive a corresponding roller cone 56 are disposed equiangularly around the forward end portion 32. Each slot 54 includes a pair of elongated angularly spaced sidewalls 54*a* and 54*b* and a pair of axially spaced endwalls 54*c* and 54*d*. The sidewalls 54*a* and 54*b* are disposed in planes extending radially and form a V-shaped cradle to rollably support a roller cone 56. In this regard, each roller cone 56 has a frusto-conical outer surface 56*a* arranged symmetrically about a central axis and between opposite end faces 56*b* and 56*c*. The cone is seated in its slot 54 such that the end faces 56*b* and 56*c* are adjacent to the endwalls 54*c* and 54*d* of the slot and an axially extending arcuate segment 58 of the cone protrudes radially into the socket 18. When seated in the slot, the inwardmost radial protrusion of the cone segments 58 are disposed on the arc of a circle having its center on the axis of rotation. The tapered wall portion 52 of the race 40 is disposed at an acute angle to the end portion 18. Importantly, the tapered wall portion 52 is dimensioned so as to be in line contact engagement with the outwardmost radial extension of the cone outer surface 56*a* such that the cone is constrained to rotate relative to and within its slot.

The lock nut 20 includes a frusto-conical base section 60 having an abutment face 60*a* adapted to seat against the sheet 24, and a cylindrical head 62 having a cylindrical surface 62*a* extending longitudinally from the base to a top end face 62*b*, the head being received in the forward socket 18. A plurality of axially extending and angularly disposed lobes 64 extend radially outwardly from the surface 62*a* with adjacent pairs of lobes forming axial troughs that open at the end face 62*b* and extend axially therefrom to the base 60. The cone segments are adapted to be received in the troughs and seat adjacent to the lobes. The lobes 64 are generally semi-cylindrical in cross-section and define a radially outward crest portion 64*a*, an arcuate flank 64*b* facing in the direction of torquing rotation, and an arcuate flank 64*c* facing away from the direction of rotation.

Each lobe has its outer periphery formed on the arc of a circle that has a diameter which is slightly less than the maximum internal diameter of the socket 18, such as defined by the inner wall of the forward end portion 32, but greater than the arc of a circle that is tangent to the inward radial extension of the cone segments 58.

The nut 20 and its associated lobes 64 is comprised of a material which undergoes plastic deformation. That is, the drive cones 56 are comprised of a material that is harder than the material of the nut 20. While many combinations of materials for the cones 56 and lobes 64 will work, in one application, the cone was comprised of carbide.

The time it takes for a rolling cone to traverse the crest of the lobe and the rotational speed of the setting tool determine the extent of relaxation of the joint, all other parameters being constant. It may be that a greater separation of troughs would be desirable to minimize relaxation to a desired preload.

The depth of the trough, the material of the lock nut, and the diameter of the lobes correlate with the diameter of the drive rollers such the lobes fail upon application of a predetermined compressive force, which in turn correlates directly with the applied torque and the preload of the joint between the lock nut and the head of the lock bolt. One way of controlling preload is by varying the amount of material the cones must inelastically deform. Preload is a function of the number of lobes and cones. Preload may also be controlled by varying the area of the lobe intercepted by the cones. A third way is to vary the hardness of the lobe relative to the material properties of the cones.

Turning to FIGS. 3–7, the race 40 has been mounted at its forwardmost axial position relative to the body 28. For a given slot 54 and cone 56, the tapered wall 52 of the race forces the cone segment 58 furthest inward radially and prevents outward radial movement of the cone.

Figure 4:
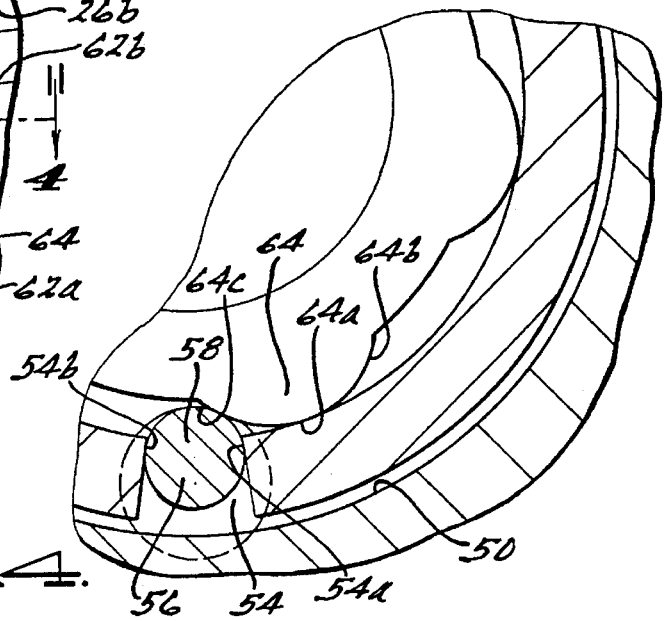
FIG. 4 is a section view taken along line 4—4 of FIG. 3 showing the drive socket positioned against a first lobe for driving the nut.
Figure 5:
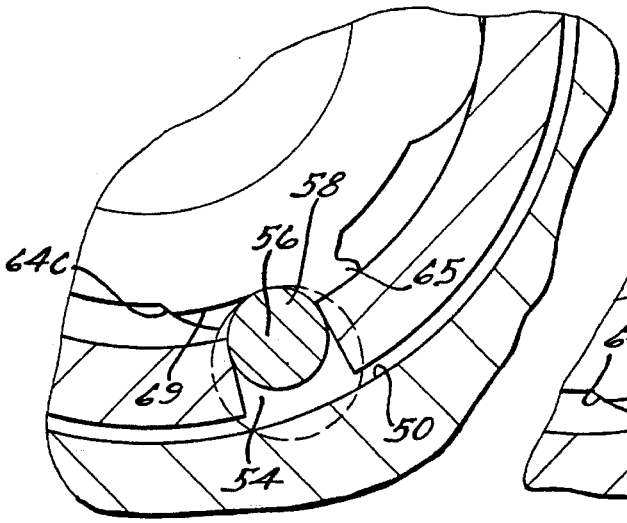
FIG. 5 is a section view, similar to FIG. 4, showing the drive socket torquing the locking nut.
Figure 6:
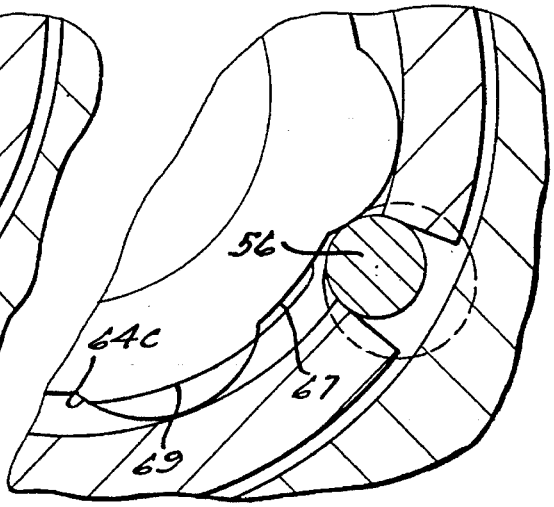
FIG. 6 is a section view, similar to FIG. 4, showing the first lobe when completely torqued by the drive socket and the drive socket rotated into position to apply torque to the next succeeding second lobe.
Figure 7:
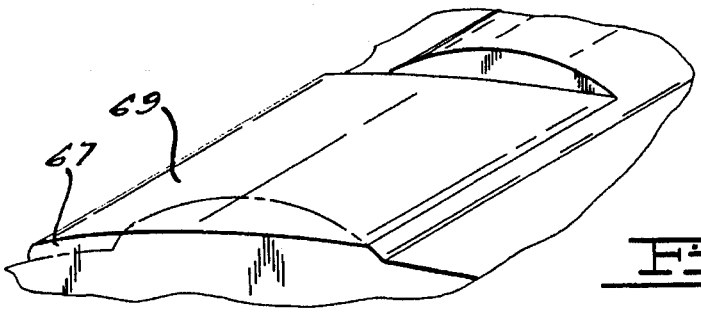
FIG. 7 is a plan view looking down on the top of the nut and showing the torqued lobe shown in FIG. 6.
Figure 8:
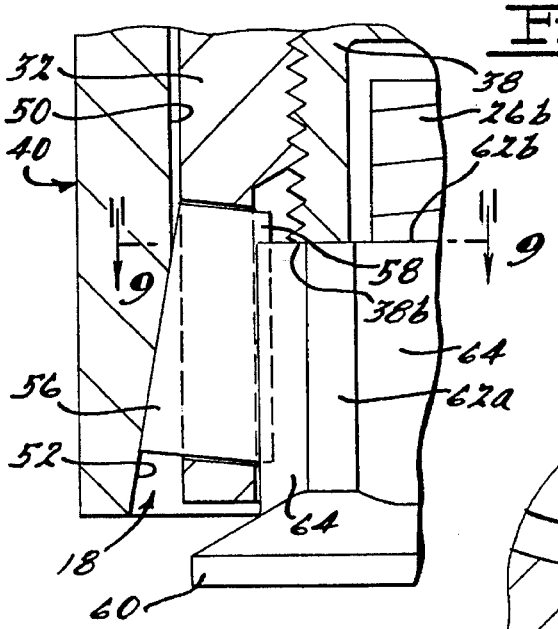
FIGS. 8–12 correspond, respectively, to FIGS. 3–7 but differ in that the socket race has been moved axially rearwardly relative to the drive socket.
Figure 9:
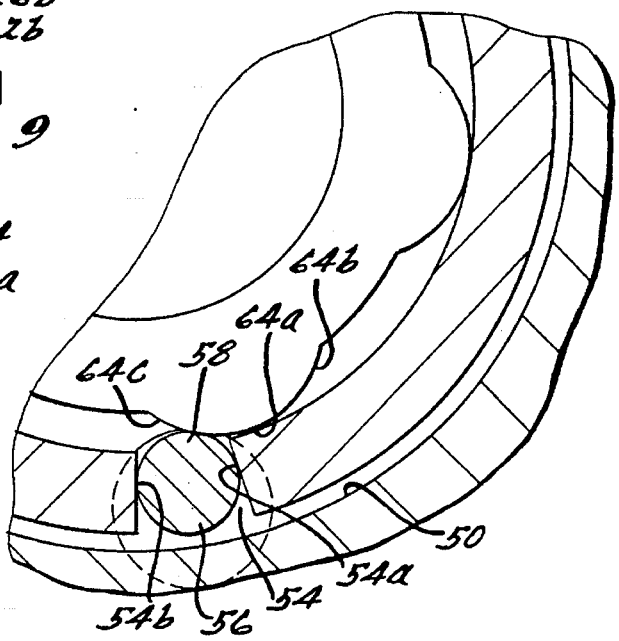
Figure 10:
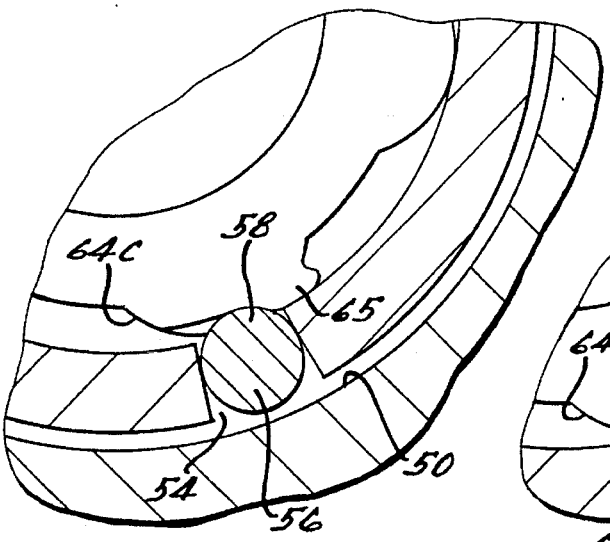

As shown in FIG. 4, upon application of a predetermined torque to the driver, the cone 54 is rotated against the flank 64*c* of the lobe 64. In FIG. 5, further torque causes the lobe to undergo radial compression towards the nut and fail in radial compression. That is, upon sufficient engagement by the driver 12 in a rotational direction tending to tighten the nut on the bolt and against the sheets to produce in conjunction with he sheet the predetermined load, the lobe deforms radially inwardly and the cone displaces material of the lobe in the direction of rotation, shown at 65. Ultimately, the cone deforms the lobe, as indicated at 67, and rotates into position against the next lobe. FIGS. 6 and 7 show the flattened portion 69 of the lobe.

Thereafter, the cone 54 is driven over the next lobe to overcome relaxation in the joint.

Figure 11:
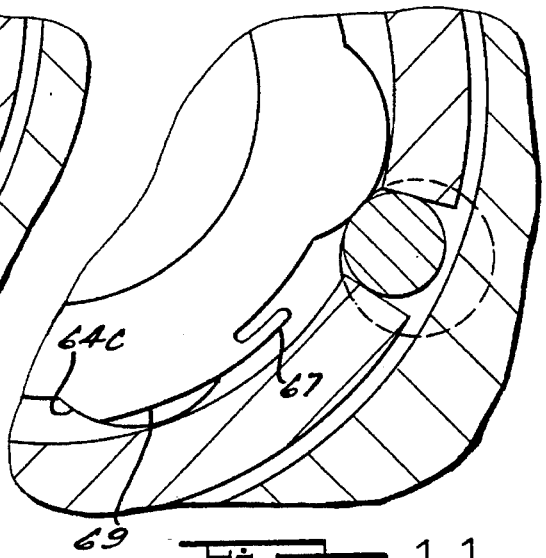
Figure 12:
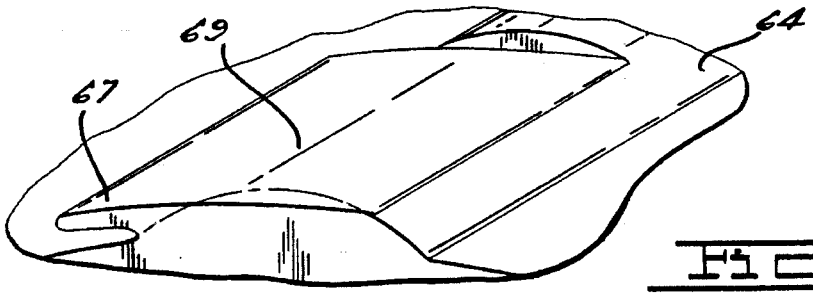

As shown in connection with FIGS. 8–12, when using a frusto-conical wall 52 and conical roller cones 56 the jam nut and sleeve have been positioned rearwardly on the rearward end portion 16, thereby permitting the race 40 to be positioned axially rearward of its forward end. In such condition, the axial retraction of the race 40 positions the frusto-conical wall 52 further radially outwardly from the roller cones and allows the cones to be forced radially outwardly from their respective sockets and towards the frusto-conical wall 52 upon the cones engaging the lobes. As such, as shown in FIGURES 11 and 12,,the cones encounter a lesser engagement with the lobes, the plastic deformation is less and the torque is less.

While the above description constitutes the preferred embodiment of the invention, it will be appreciated that the invention is susceptible to modification, variation, and change without departing from the proper scope or fair meaning of the accompanying claims.

What is claimed is:

1. A method of setting a joint of a threaded nut, a threaded bolt and at least one sheet, the nut having a plurality of plastically deformable lobes on its exterior surface and being threaded onto the bolt, the at least one sheet being positioned between the nut and the head of the bolt, the steps of the method comprising:

mounting a plurality of frustoconical rollers in rolling relation in a driver socket;

positioning the nut into the socket with each roller being adjacent to a respective lobe;

rotating the driver until the nut is tightened onto the bolt with a predetermined torque and subsequently forcing each roller over its respective lobe, thereby plastically deforming a portion of each respective lobe.

2. The method as claimed in claim 1 including the additional step of causing each roller to rollably engage an adjacent lobe.

3. The method as claimed in claim 1 including the step of mounting the rollers into a cylindrical first sleeve for rolling movement therewithin, mounting a second sleeve around the first sleeve and said rollers, and positioning the first sleeve relative to the nut such that each roller encounters a specified engagement with its respective lobe.

4. The method as claimed in claim 3 including the step of positioning the second sleeve such that an interior wall of said second sleeve engages the rollers to prevent outward radial movement of the rollers away from their mounting in the first sleeve.

5. The method as claimed in claim 3 including the step of moving the second sleeve rearwardly relative to the first sleeve whereby each roller may be forced radially outwardly and away from its respective lobe, thereby reducing the amount of material that is plastically deformed by each roller.

* * * * *

UNITED STATES PATENT AND TRADEMARK OFFICE

CERTIFICATE OF CORRECTION

PATENT NO. : 5,517,742

DATED : May 21, 1996

INVENTOR(S) : Brian Mann

It is certified that error appears in the above-indentified patent and that said Letters Patent is hereby corrected as shown below:

Col. 1, line 15, "-system" should by --system--

Col. 1, line 28, "Joint" should be --joint--

Col. 1, line 32, "of-torque" should be --of torque--

Col. 3, line 10, "FIGURE i" should be --FIGURE 1--

Col. 3, line 51, "socketing" should be --socket 18--

Col. 3, line 52, after "top" insert --of--

Signed and Sealed this

Third Day of September, 1996

*Attest:*

Bruce Lehman

BRUCE LEHMAN

*Attesting Officer*

*Commissioner of Patents and Trademarks*